United States Patent [19]

Shocknesse

[11] 4,360,796

[45] Nov. 23, 1982

[54] REGISTER-GATE SYSTEM

[76] Inventor: Ronald L. Shocknesse, 2851 S. King Dr., Apt. 618, Chicago, Ill. 60616

[21] Appl. No.: 242,131

[22] Filed: Mar. 9, 1981

[51] Int. Cl.[3] ..... G08G 1/14; E05F 15/20; H01H 3/16

[52] U.S. Cl. ..... 340/51; 49/30; 49/70; 49/357; 194/DIG. 23; 200/61.61; 340/31 R

[58] Field of Search ..... 340/45, 51, 22, 31 R; 49/35, 70, 357, 49, 29, 30; 194/DIG. 23, DIG. 24; 235/22, 93; 200/61.61

[56] References Cited

U.S. PATENT DOCUMENTS

| | | | |
|---|---|---|---|
| 2,581,788 | 1/1952 | Dunn . | |
| 2,627,920 | 2/1953 | Ba rlow . | |
| 2,646,215 | 7/1953 | Stovall . | |
| 2,672,393 | 3/1954 | Cooper . | |
| 2,735,202 | 2/1956 | King | 49/49 |
| 2,741,859 | 4/1956 | Castle | 49/49 |
| 2,769,165 | 10/1956 | Bower . | |
| 2,842,876 | 7/1958 | Chicoine | 49/49 |
| 2,874,819 | 2/1959 | Nutter | 49/49 |
| 2,906,505 | 9/1959 | Orr et al. | 49/49 |
| 3,046,522 | 7/1962 | Auer | 340/51 |
| 3,063,179 | 11/1962 | Auer . | |
| 3,090,941 | 5/1963 | Breese | 340/31 |
| 3,109,926 | 11/1963 | Bolton | 235/92 TC |
| 3,317,892 | 5/1967 | Schwarz | 340/31 |
| 3,484,586 | 12/1969 | Wilson et al. . | |
| 3,575,586 | 4/1971 | Kroll | 340/51 |
| 3,626,637 | 12/1971 | Rudicel | 49/25 |
| 3,641,314 | 2/1972 | Abramson | 340/51 |
| 3,663,936 | 5/1972 | Boudouris et al. | 340/31 R |
| 3,681,751 | 8/1972 | Le Barre | 340/22 |
| 3,686,627 | 8/1972 | Rubenstein | 340/31 R |
| 3,686,794 | 8/1972 | Sakamoto et al. | 49/49 |
| 3,691,685 | 9/1972 | Danin | 49/49 |
| 3,705,976 | 12/1972 | Platzman | 340/51 |
| 3,766,363 | 10/1973 | Dhooge | 340/51 |
| 3,775,593 | 11/1973 | Gieringer et al. | 340/51 |
| 3,815,718 | 6/1974 | Singer | 235/92 TC |
| 3,855,432 | 12/1974 | Kelly et al. | 200/61.61 |
| 3,876,973 | 4/1975 | Griebel | 340/45 |
| 3,968,596 | 7/1976 | Danin | 49/49 |
| 3,993,975 | 11/1976 | Long et al. | 340/51 |
| 4,016,679 | 4/1977 | Ellefson | 49/49 |
| 4,021,644 | 5/1977 | Dreslinski | 235/92 TC |
| 4,101,745 | 7/1978 | Smith | 200/61.61 |
| 4,182,539 | 1/1980 | Busch | 312/333 |
| 4,195,442 | 4/1980 | Keeling | 49/35 |

*Primary Examiner*—James J. Groody
*Attorney, Agent, or Firm*—Hill, Van Santen, Steadman, Chiara & Simpson

[57] ABSTRACT

An anti-theft system for use in an attended parking lot has a cash register and an exit gate. Upon ringing up a transaction, when the cash drawer is unlatched, a normally closed switch, held open by a portion of the drawer latch, is permitted to close thereby opening the exit gate. The latch immediately returns to its locking position reopening the switch.

5 Claims, 8 Drawing Figures

REGISTER-GATE SYSTEM

BACKGROUND OF THE INVENTION

1. Field of the Invention

The invention pertains to the field of anti-fraud devices adapted for use with attendant controlled parking lots or fare collection systems.

2. The Prior Art

In any situation where a fee or a fare is to be collected for the use of a facility a potential exists that not all of the fees actually collected will be delivered to management. This problem is made more difficult by the fact that the members of the public, from whom the fees are usually collected, often have no motivation or interest in insuring that each use fee paid is actually turned over to the management of the facility. One system designed to deal with this problem is a pedestrian control system disclosed in U.S. Pat. No. 3,681,751.

Where the facility is a parking lot with parking assigned on a weekly or longer basis, systems have been developed wherein parking gates control the entrance to or egress from the lot. A person authorized to park at the facility can open the gates by use of a key card. Such systems as those shown, for example, in U.S. Pat. Nos. 2,842,876; 4,016,679, incorporated herein by reference, work well where a relatively stable population uses the facility on a long term basis.

Other parking lot systems have been developed wherein coins are inserted into an exit coin mechanism connected to a barrier or gate. When the correct amount of coinage has been deposited, the gate is opened and the user can drive through. Such systems have been disclosed in U.S. Pat. Nos. 2,735,202; 2,741,859; 2,874,819 and 2,906,505, all incorporated herein by reference.

Additionally, where an attendant is required in a toll booth, elaborate fraud prevention systems have been developed which include remote audit panels, vehicle sensors and electrical circuits to insure that each exiting car is charged a fee corresponding to the time interval during which it was parked at the facility. One such system is disclosed in the specification and figures of U.S. Pat. No. 3,317,892, incorporated herein by reference. In the system of the '892 patent, a traffic light is switched from red to green permitting a vehicle to exit the facility when an attendant totals up the fee due on a cash register. When a motor in the cash register is cycled, a switch is closed by the rotating shaft of the motor which then turns the traffic light to green. Other systems are disclosed in U.S. Pat. Nos. 3,090,941 and 3,575,586, also incorporated herein by reference.

In other systems in public use, a cash register-parking gate combination is used to minimize fraud. One such system noted in U.S. Pat. No. 3,815,718 incorporated herein by reference utilizes an exit gate opened at the completion of the transaction so that the vehicle may depart.

Such cash registers are conventional and are shown in the '892 patent and in U.S. Pat. No. 4,182,539, incorporated herein by reference. Additional cash register latch mechanisms are also disclosed in U.S. Pat. Nos. 3,855,432 and 4,101,745, both incorporated herein by reference.

In a known system in public use a switch which actuates a raisable parking gate is held in an open condition by a rear portion of the cash drawer in the cash register. Depressing the "Total" key on the register records the transaction and releases the cash drawer which then opens as is conventional.

When the drawer is released, it moves away from the gate control switch. The switch then closes signalling the gate actuator to raise the gate thereby permitting the car to exit. As the car leaves, it rides over a pavement switch which recloses the barrier such as shown in the '876 patent.

The attendant then deposits the collected fees into the cash drawer and recloses the drawer. When the drawer is reclosed in the prior art system, it reopens the gate control switch. Attention has been given in the art to developing means to sense when the drawer has been fully latched closed as shown in the '432 and '745 patents.

I have found that there exist substantial opportunities to defraud the parking lot management in the known attendant controlled systems. In my investigations, I have discovered that the attendants often do not close the cash drawer completely after a transaction. The attendants have discovered that the gate control switch is engaged and reopened by the end of the drawer shortly before the drawer is relocked. Thus, an attendant can push a drawer almost closed engaging the switch and resetting gate actuator. When the next car approaches the attendant's booth, the attendant need not recycle the cash register. Instead, the attendant merely pulls open the drawer thus permitting the switch to close, signalling gate actuator to raise the barrier. After paying the unrecorded parking fee, the car can exit reclosing the barrier and the attendant would pocket that fee.

I have also discovered that the relationship between the drawer and the switch can not be reliably adjusted so that the switch can not be reopened without latching the drawer closed. The ability of an attendant to open the barrier without registering a collected fee represents a loss of thousands of dollars a month to parking lot owners.

Even the use of remote fee displays or the requirement that a stamped time ticket be inserted into the register each time a fee is rung up, both disclosed in the '892 patent, are no protection where the attendant is able to manipulate the barrier as described above.

Thus, there continues to be a need for a system to open parking facility barriers that is inexpensive, reliable, adaptable to all cash registers without extensive modifications and not manipulatable by the attendants.

SUMMARY OF THE INVENTION

My invention comprises an improved register-gate system and method for the purpose of minimizing lost fees. My improved system includes a cash register and a barrier or gate actuator adapted to raise a parking exit barrier, and a switch which is adapted to cause the exit barrier to open. In my invention, the switch senses when a locking latch in the cash register moves to its unlocked position thereby permitting the cash drawer to open. The switch then opens the exit barrier. When the latch drops back to its rest position, once the drawer has been unlocked and the barrier opened, the switch is returned to its open position thereby reinitiating the gate actuator for the next operating cycle.

An important aspect of my invention involves the fact that I operate the gate activation switch off of a portion of the drawer latch mechanism that for a short period of time moves a limited distance in a first direction, once the transaction is rung up and the drawer is to be unlocked, and which shortly thereafter moves a limited distance opposite the first direction back to its rest position independently of when the drawer is actually closed. When the activating portion of the latch mechanism moves in the first direction, due to an energized solenoid, a normally closed switch which has been held open is permitted to close, thereby triggering the barrier actuator and opening the exit barrier. The solenoid is then de-energized and returns to its rest position before the drawer is closed. When the solenoid returns to its rest condition, the normally closed spring loaded switch is reopened, initializing the barrier actuator for the next cycle.

I thus close and reopen the barrier activator switch once for each transaction recorded on the register by sensing movement of a portion of the drawer latch which moves only to unlock the drawer and then returns to its rest position. In my invention, I adjust the gate actuation switch, preferably a spring biased normally closed switch such as a MICROSWITCH, such that the drawer latch must move substantially the full unlocking distance before the switch closes to cause the barrier to open. By means of this interrelationship between the latch and the switch, if the latch moves a lesser distance such as when the drawer is reclosed, the switch will not close spuriously. Thus, my invention is suitable for use with register latches or associated linkages which do not move when the drawer is reclosed or which move a shorter distance when the drawer is reclosed than when the drawer is opened.

My inventive method includes the steps of:

unlatching the cash drawer;

sensing movement of the cash drawer latch as it releases the drawer;

generating a selected signal in response to the sensed movement; and raising the barrier in response to the signal.

DETAILED DESCRIPTION OF THE PREFERRED EMBODIMENTS

Not by way of limitation but by way of disclosing the best mode of practicing my invention and by way of enabling one of skill in the art to practice my invention, one embodiment of my invention is disclosed in FIGS. 1 through 6 discussed hereafter.

Figure 1:
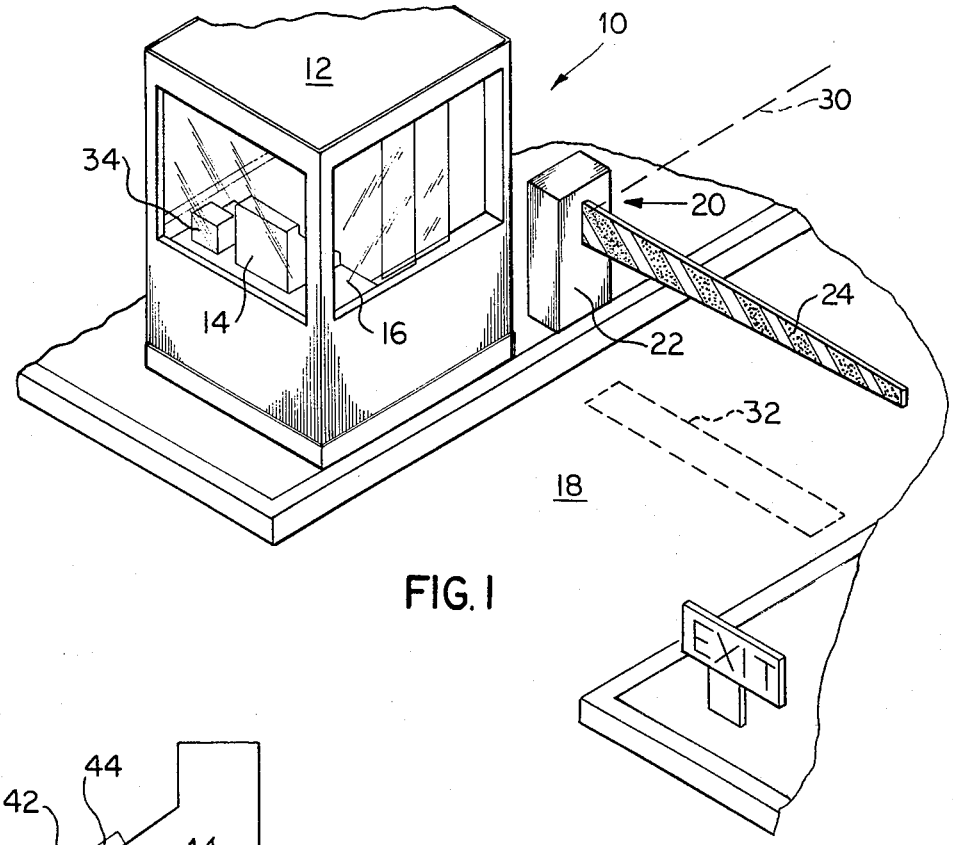
FIG. 1 is a fragmentary perspective view of a parking lot exit control system incorporating the principles of my invention.

In FIG. 1, a parking lot control system or toll gate control system is generally indicated at 10. System 10 includes a cashier's booth 12 including a cash register 14 and a window area 16. Booth 12 is adjacent an exit driveway 18. A gate system 20 is positioned on the exiting side of booth 12 and has a supporting housing 22 and a pivoted barrier or gate 24. A gate actuator mechanism 26 (See FIG. 2) located in support housing 22 is adapted to pivotably rotate barrier 24 from an essentially horizontal blocking position as shown in FIG. 1 to an essentially vertically non-blocking position indicated by a dashed line 30 in FIG. 1. Gate actuator mechanism 26 is a conventional mechanism, examples of which are shown in the '876 and '505 patents previously incorporated herein by reference. A vehicle actuated closure switch 32 is mounted in the exit drive 18.

The system 10 of FIG. 1 is designed to operate as follows

1. An exiting vehicle approaches the attendant's booth 12 and enters exit lane 18 stopping adjacent window area 16.

2. An attendant in the booth 12 determines the amount due. This may be by receiving a stamped parking ticket from the driver of the vehicle 18 and using stamping clock 34 to determine the exit time, hence the duration in the facility, or alternately, if the system 10 is used in a toll facility, the amount due may be determined by counting the axles on the vehicle or some other such conventional means.

3. The driver of the vehicle hands to the attendant in booth 12 funds necessary to cover the amount due.

4. The attendant cycles register 14 thereby ringing up the transaction, and if necessary, obtains change from the cash register drawer to return to the vehicle's driver. Simultaneously, the barrier 24 is raised from its closed position to its open position 30.

5. The driver of the vehicle exits on lane 18 driving over switch 32 which actuates the gate actuator mechanism 26 to reclose gate 24.

Figure 2:
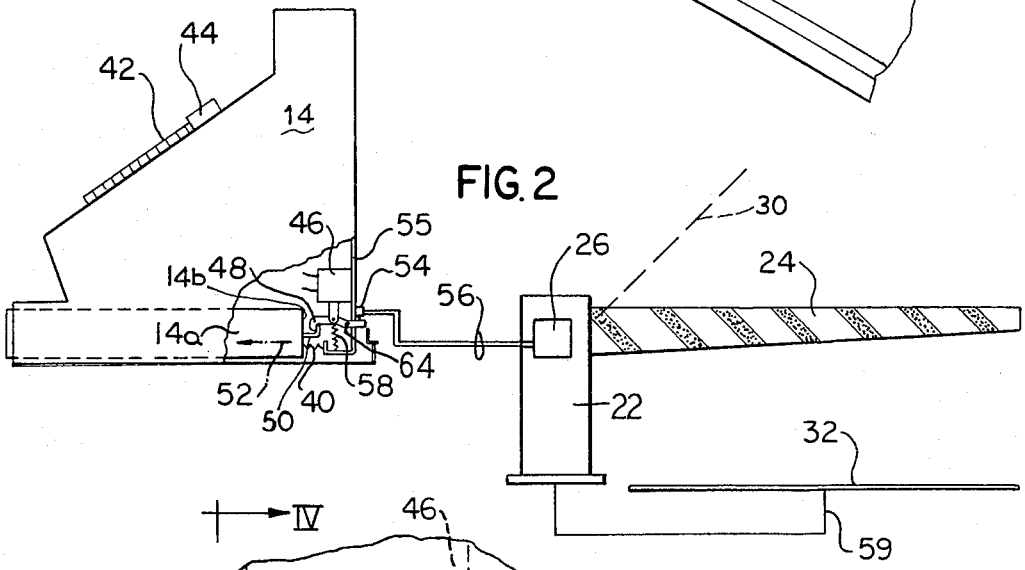
FIG. 2 is a schematic enlarged view illustrating the principles of my invention.

FIG. 2 is a schematic view showing in an overall fashion, an improved apparatus in which the gate actuator mechanism 26 is signalled to cause the barrier 24 to move from its closed position to its open position 30. Drawer **14*a* is biased by a spring 40 pushing on a rear surface 14*b* of cash register drawer 14*a* toward an open position. When the attendant has entered a current transaction onto the keys 42 of the cash register 14, a totalize button 44 is then depressed. Once the totalize button 44 is depressed, the register cycles through its normal operation, recording the transaction, and energizing for a brief period of time a solenoid 46. Solenoid 46 retracts a latch 48 which has engaged a bracket 50 attached to the rear 14*b* of the drawer 14*a*. The drawer is then opened under the influence of spring 40 as is conventional. When the drawer 14*a* opens it moves in a direction 52**.

A normally closed gate control micro-switch 54 is held open by latch member 48 when the drawer **14*a* is shut. Switch 54 is affixed to a rear section 55 of the register 14 and is connected by wires 56 to gate actuator mechanism 26**.

An extended spring 58 tends to pull the latch 48 downwardly toward the locking position. When the latch member 48 moves from the locking position to a release position due to solenoid 46 having been temporarily energized, switch 54 closes applying a signal on lines 56 to gate actuator mechanism 26 to open gate 24. Gate 24 is then moved to its open position 30. When the vehicle exits and closes switch 32 connected by lines 59 to gate actuator mechanism 26, the gate 24 is reclosed.

Figure 3:
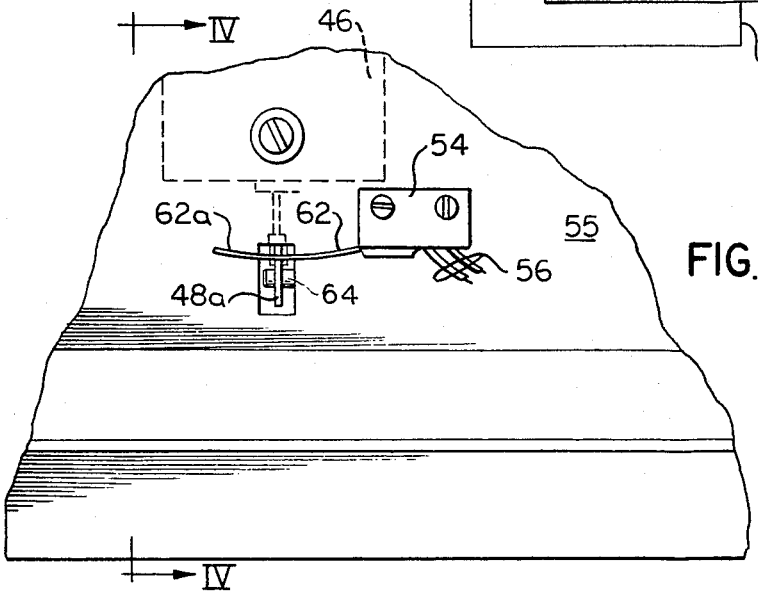
FIG. 3 is an enlarged fragmentary partial view showing the interrelationship of the cash register latch and the gate opening switch according to my invention.

FIG. 3 discloses details of the structure of the system of FIG. 2. In my improved system, I position a normally closed spring biased switch 54 such as a micro-switch with an actuating arm 62 adjacent a section 48*a* of the drawer latching member 48. Switch 54 is connected by wires 56 to the actuating mechanism 26. When the totalize button 44 on the register 14 is depressed and solenoid 46 is actuated for a short period of time, latch 48 retracts to unlock drawer 14*a*. The retraction of latch 48 retracts the portion 48*a*, permitting the member 62 of the switch 54 to move such that the switch can go from an open or non-conducting condition to its normally closed condition. This closure of switch 54 via lines 56 signals the gate actuating mechanism 26 to open the gate 24. Once the drawer 14*a* has moved away from the latch mechanism 48, solenoid 46 is deenergized permitting the latch mechanism 48, including portion 48*a*, to return to its original locking or resting condition. When portion 48*a* of the latch 48 returns to its initial condition, it engages portion 62*a* of member 62 of the switch 54 reopening the switch 54. The latch member 48 pivots about a fixed cylindrical member 64.

When the drawer 14*a* is forced closed by the attendant the member 50 engages the latch 48. However, the portion 48*a* of the latch 48 does not move enough to permit arm 62 to reclose switch 54. Thus, forcing the drawer 14*a* closed and locked cannot signal the gate actuator mechanism 26 to reopen the gate 24. Because I permit switch 54 to close using portion 48*a* of the latch member 48 only when the latch member 48 is fully retracted for the purpose of unlocking the drawer 14*a*, which only occurs when the totalize button 44 has been depressed, my improved system cannot be manipulated by the attendant. Further, because I set the throw of the arm 62 such that the latch portion 48*a* must move through its entire unlocking distance to enable switch 54 to close, thereby opening gate 24, there are essentially no critical adjustments associated with my system.

Figure 4:
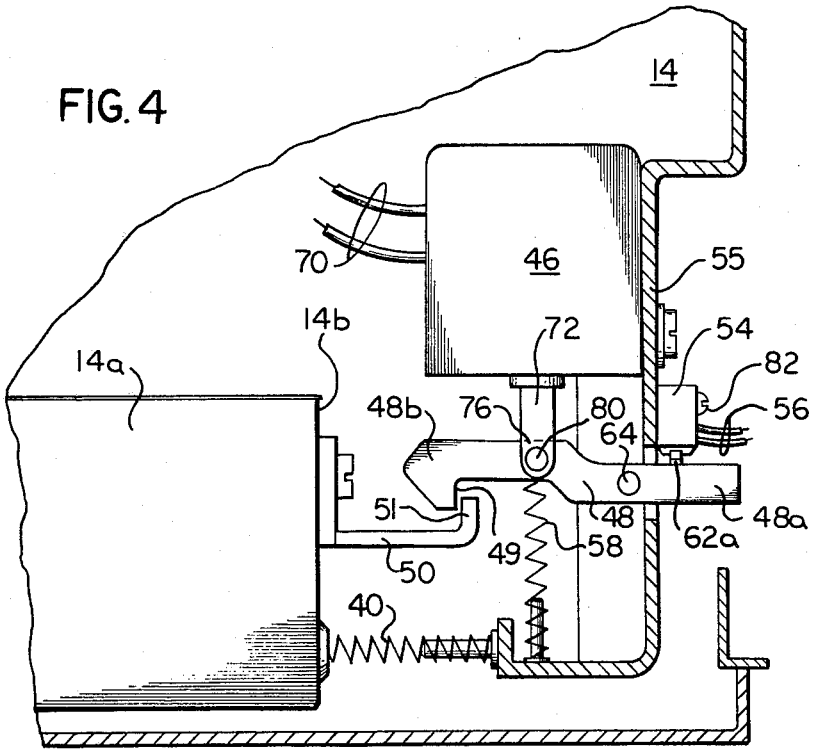
FIG. 4 is an enlarged fragmentary sectional view illustrating the interrelationship of the cash register locking linkage to the gate opening switch according to the principles of my invention.

FIG. 4 is an enlarged fragmentary sectional view of the structure of my system when the register drawer 14*a* is locked closed. FIG. 4 shows the solenoid 46 which is actuated by a set of wires 70 when the totalizer button 44 is depressed. The solenoid 46 has a vertically movable arm 72. When the solenoid 46 is energized, the arm 72 is retracted vertically within the solenoid 46. Switch 54 is shown affixed to the rear member 55 of register 14 by screws 82. The solenoid arm 72 has an end 76 which is farthest away from the solenoid 46. Latch member 48, which is an elongated member and has portion 48*a* which was previously discussed, engages switch arm 62*a* and a second portion 48*b* which latches member 50, locking drawer 14*a* closed. Latch member 48 is connected to solenoid arm 72 at the end 76 by a pivot point 80 which is located between portions 48*a* and 48*b*. The tension spring 58 pulls latch member 48 away from the solenoid 46. The latch member 48 can rotate a limited amount about the fixed pivot point 64.

Figure 5:
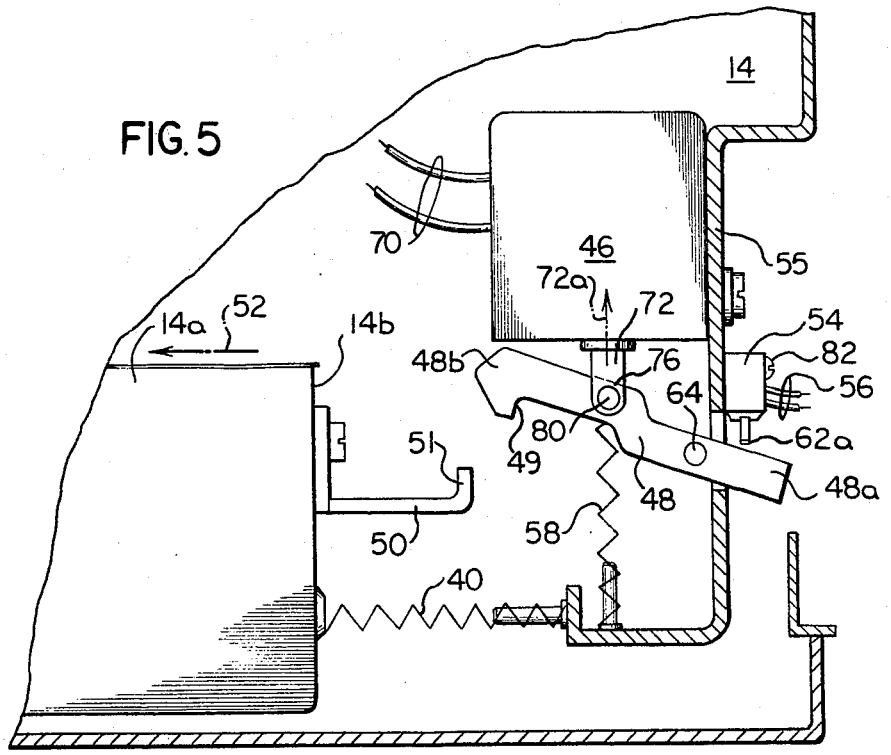
FIG. 5 illustrates the structure of FIG. 4 immediately after a totalize key on the cash register has been depressed and the cash register drawer has started to open.

FIG. 5 discloses the transient condition found in my system immediately after the totalize button 44 has been depressed. As can be seen from FIG. 5, the solenoid 46 has been energized by lines 70 retracting arm 72 in a direction 72*a* within solenoid 46. When arm 72 retracts, it moves the pivot point 80 of the latching arm 48 essentially vertically upwardly further extending the spring 58, simultaneously causing member 48 to pivot about member 64. The front locking portion 48*b* of the member 48 is lifted off of latch member 50. Under this set of conditions, spring 40 forces drawer 14*a* open in the direction 52. Further, the portion 48*a* moves downwardly away from the switch arm 62*a*. Switch 54 then closes and via lines 56 signals gate actuator mechanism 26 to open gate 24. I have found that by arranging switch arm 62 such that portion 48*a* must move to its extreme unlocked position as shown in FIG. 5 before switch 54 changes state results in a system with no critical adjustments.

Shortly after drawer 14*a* has moved toward its open position, solenoid 46 is deenergized and latch member 48 returns to its original condition under the influence of spring 58, reopening switch 54. This position corresponds to the position of the latch member 48 shown in FIG. 4.

Figure 6:
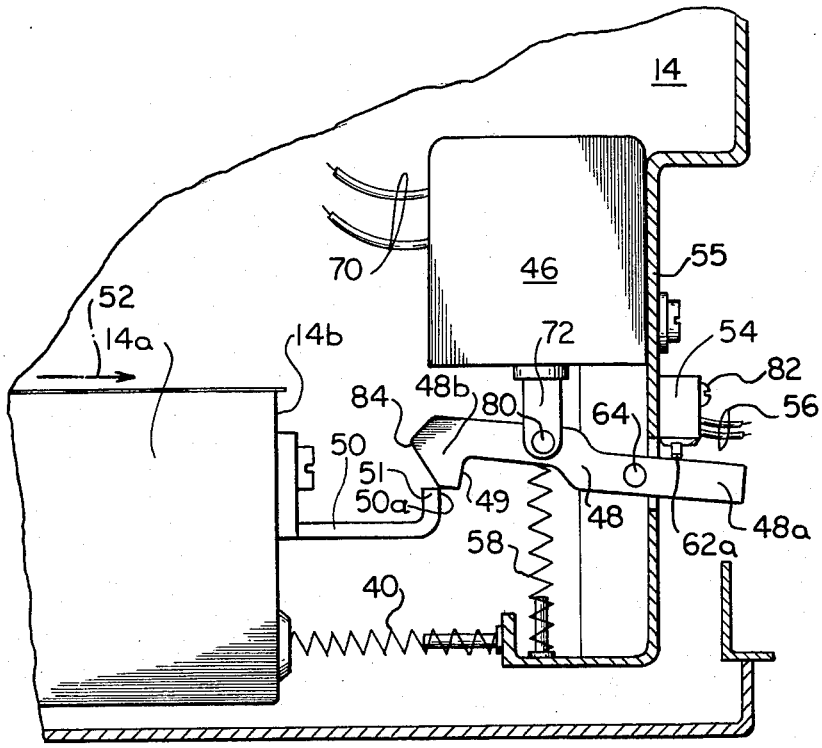
FIG. 6 shows the same structure as in FIG. 5 after the cash register unlocking solenoid has been deenergized and the cash drawer is being reclosed.

As can be seen from FIG. 6, when the attendant pushes drawer 14*a* closed, an upper edge 50*A* of member 50 engages locking member 48*b* along a camming surface 84. The interaction of surface 50*a* and camming surface 84 forces portion 48*b* of the latch member 48 upward slightly simultaneously with forcing portion 48*a* of the member 48 downward slightly. Portion 48*a* is forced downward slightly but not enough that switch 54 is permitted to close, hence, the gate 24 is not opened when the drawer is closed. When the drawer is fully closed, the locking tab 51 of the locking member 50 has passed behind edge 49 of the locking member 48. Spring 58 pulls the locking member 48 downwardly relatching the drawer as shown in FIG. 4.

Figure 7:
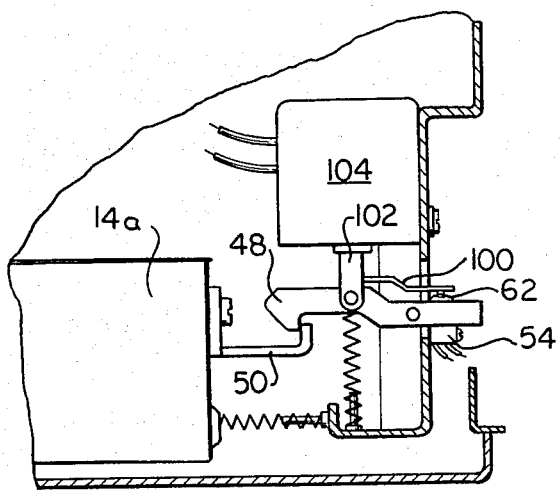
FIG. 7 is a schematic view of an alternate embodiment of my invention in a locked condition.
Figure 8:
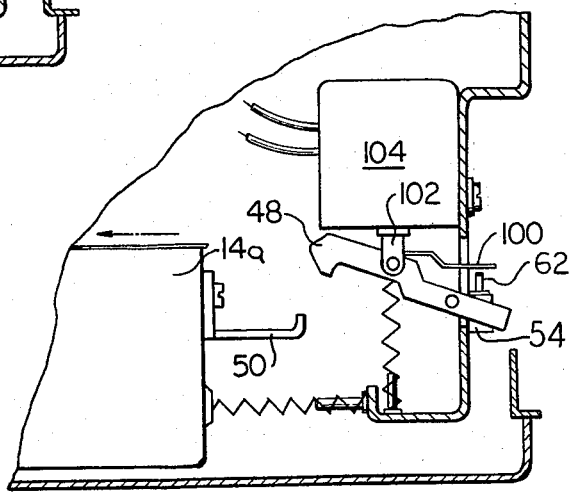
FIG. 8 is a schematic view of the alternate embodiment of FIG. 7 with the drawer solenoid energized and the drawer moving to an open position.

An alternate embodiment of my invention is shown in FIGS. 7 and 8, wherein a rigid arm 100 is directly attached to a solenoid arm 102.

FIG. 7 shows the drawer 14*a* locked closed by latching member 48 as in FIGS. 2–5. In the embodiment of FIG. 7, however, rigid arm 100 is in contact with actuator arm 62 of switch 54. So long as solenoid 104 is not energized rigid arm 100 is in contact with arm 62 and keeps switch 54 open.

FIG. 8 depicts the alternate embodiment with solenoid 104 activated for a brief period of time in response to totalize key 44 having been manually depressed. With solenoid 104 activated, rigid arm 100 moves upwardly with solenoid arm 102. When arm 100 approaches its uppermost position, it moves away from switch arm 62 permitting switch 54 to change state and open the gate.

Subsequently, solenoid arm 102 returns to its initial position once the solenoid 104 has been de-energized. Rigid arm 100 then reengages switch arm 62 reopening switch 54. When the operator relocks drawer 14 the movement of the latch member 48 and solenoid arm 102 is not enough to permit switch 54 to reclose.

While various modifications and changes might be proposed by those of skill in the art, it will be understood that I wish to include within the claims of any patent warranted hereon all such modifications and changes as reasonably come within my contribution to the art.

I claim as my invention:

1. In a system having a barrier movable by a barrier actuation apparatus in response to a selected electrical signal and a manually operable cash register with a lockable drawer, the drawer is released by a latch mechanism in the register in response to a transaction having been entered into the register, an improvement comprising:

means for sensing a selected amount of movement of a selected portion of the latch mechanism in a first direction, in response to a transaction having been entered, as the latch mechanism moves to unlock the drawer;

means for supplying the selected electrical signal to the barrier actuation apparatus in response to said means for sensing having sensed the selected amount of movement in the first direction;

means for sensing a selected amount of movement of the selected portion of the latch mechanism opposite the first direction immediately after the drawer has been unlocked; and said means for supplying including means for interrupting the selected signal to the barrier actuation apparatus in response to said means for sensing having sensed the selected amount of movement of the selected portion of the latch mechanism opposite the first direction.

2. In a system having a barrier movable by a barrier actuation apparatus in response to a selected electrical signal and a manually operable cash register with a lockable drawer, the drawer is released by a latch mechanism in the register in response to a transaction having been entered into the register, an improvement comprising:

spring biased switching means affixed to selected region of the cash register, adjacent the latch mechanism;

said spring biased switching means includes elongated means for sensing a selected movement of a selected part of the latch mechanism as that part moves to unlock the drawer in response to a transaction having been entered;

said means for switching is adapted to switch from a first to a second state in response to said means for sensing having sensed the selected movement of the part of the latch mechanism, said means for switching thereby supplies the selected signal to the barrier actuation apparatus which moves the barrier from a blocking to a non-blocking position;

said means for switching is adapted to switch from the second to the first state in response to said means for sensing having sensed a selected opposite movement of the part of the latch mechanism shortly after the drawer has been unlocked.

3. An anti-fraud system including a cash register with a movable drawer, a barrier movable from a closed to an open position by a barrier moving apparatus in response to said apparatus receiving a selected electrical signal, means for latching the drawer closed, said means for latching is operable in response to a selected key on the register being manually depressed to release and to permit the drawer to move to an open position, means for sensing movement of a portion of said means for latching from a locking position to a non-locking position, permitting the drawer to open, in response to said selected key on the register being depressed, means for switching adapted to switch from a first to a second state in response to said means for sensing having sensed movement of said portion of said means for latching to the non-locking position, while in said second state said means for switching is adapted to transmit the selected signal to said barrier moving apparatus to cause said barrier moving apparatus to open the barrier, said means for latching is adapted to return to the locking position shortly after said drawer moves toward the open position, said means for sensing is further adapted to sense the movement of said means for latching toward the locking position and said means for switching is further adapted to switch from the second to the first state in response to said means for switching having sensed movement of said portion of said means for latching toward the latching position, thereby removing the selected signal, irrespective of the position of the drawer.

4. A method of improving quality control over receipts at an exit controlled vehicular facility having an exit lane, a movable lane-blocking barrier having a blocking and a non-blocking position, an attendant occupied booth, and a cash register with a drawer, the drawer is locked by a latch and can be opened for receiving fees for vehicular use of the facility by depressing a manually operable key, the method comprises the steps of:

moving the latch from a locking position thereby unlocking the drawer of the cash register in response to a selected key on the register being manually depressed;

sensing essentially an extreme position of a selected portion of the latch as the latch is moved to unlock the drawer;

generating a selected electrical signal in response to sensing essentially the extreme position of the selected portion of the latch;

moving the barrier from the blocking to the non-blocking position in response to the selected electrical signal simultaneously while moving the drawer from a locked toward an open position;

returning the latch to the locking position while the drawer is moving from the locked to the open position;

sensing movement of the latch toward the locking position;

interrupting the selected electrical signal while the drawer is unlocked in response to a selected amount of movement of the latch toward the locking position.

5. The method according to claim 4 including the additional steps of:

sensing movement of the drawer of the cash register from the open position toward the locked position;

moving at least a portion of the latch in response to the sensed drawer movement, to permit the drawer to assume the locked position, without moving the selected portion of the latch to essentially the extreme position thereby blocking generation of the selected electrical signal; and moving the latch so as to lock the drawer closed.

* * * * *